US007733291B2

(12) United States Patent
Swais

(10) Patent No.: US 7,733,291 B2
(45) Date of Patent: Jun. 8, 2010

(54) ANTENNA RADIAL SYSTEMS AND RELATED METHODS

(75) Inventor: Imad M. Swais, Bloomingdale, IL (US)

(73) Assignee: Laird Technologies, Inc., Chesterfield, MO (US)

( * ) Notice: Subject to any disclaimer, the term of this patent is extended or adjusted under 35 U.S.C. 154(b) by 495 days.

(21) Appl. No.: 11/871,914

(22) Filed: Oct. 12, 2007

(65) Prior Publication Data

US 2009/0085824 A1 Apr. 2, 2009

Related U.S. Application Data

(60) Provisional application No. 60/976,771, filed on Oct. 1, 2007.

(51) Int. Cl.
*H01Q 1/12* (2006.01)

(52) U.S. Cl. ..... 343/878; 343/876; 343/882; 343/873

(58) Field of Classification Search ..... None
See application file for complete search history.

(56) References Cited

U.S. PATENT DOCUMENTS 4,089,817 A 5/1978 Kirkendall
6,133,885 A * 10/2000 Luniak et al. ..... 343/702
7,427,960 B2 * 9/2008 Mizutani et al. ..... 343/702
2004/0194994 A1 10/2004 Rasmussen
2006/0044207 A1 * 3/2006 Dolson ..... 343/878
2008/0303740 A1 * 12/2008 Schipper et al. ..... 343/878

FOREIGN PATENT DOCUMENTS

JP 56050601 5/1981
KR 102004080207 9/2004

OTHER PUBLICATIONS

Dxengineeering 070815, Installation instructions Hustler 4-BTV, 5BTV trap vertical (Fig. 1 and Fig. 7), 14 pages.

* cited by examiner

*Primary Examiner*—Trinh V Dinh
(74) *Attorney, Agent, or Firm*—Harness, Dickey & Pierce, P.L.C.

(57) ABSTRACT

According to various aspects, exemplary embodiments are provided of antenna radial systems. In one exemplary embodiment, an antenna radial system generally includes a washer having a channel disposed along a first side of the washer. A radial includes a locking portion configured to be received within the channel. The radial also includes elongate portions extending outwardly from the locking portion such that an angle is defined between each elongate portion and the locking portion. A bushing cooperates with the washer for sandwiching the radial's locking portion therebetween to thereby help retain the radial's locking portion within the channel.

25 Claims, 8 Drawing Sheets

ANTENNA RADIAL SYSTEMS AND RELATED METHODS

CROSS-REFERENCE TO RELATED APPLICATION

This application claims the benefit of U.S. Provisional Application No. 60/976,771 filed Oct. 1, 2007. The disclosure of this provisional application is incorporated herein by reference.

FIELD

The present disclosure generally relates to antenna radial systems.

BACKGROUND

The statements in this section merely provide background information related to the present disclosure and may not constitute prior art.

Antenna radial systems are sometimes used to simulate a ground plane to enhance radio frequency (RF) radiation. For example, an antenna radial system may be used to convert a mobile antenna to a base station antenna.

SUMMARY

According to various aspects, exemplary embodiments are provided of antenna radial systems. In one exemplary embodiment, an antenna radial system generally includes a washer having a channel disposed along a first side of the washer. A radial includes a locking portion configured to be received within the channel. The radial also includes elongate portions extending outwardly from the locking portion such that an angle is defined between each elongate portion and the locking portion. A bushing cooperates with the washer for sandwiching the radial's locking portion therebetween to thereby help retain the radial's locking portion within the channel.

Additional aspects provide methods relating to antenna radial systems, such as methods of assembling, installing and/or using antenna radial systems. The antenna radial system may generally include a washer, a radial, and a bushing. In one exemplary embodiment, a method generally includes positioning a radial relative to the washer such that a locking portion of the radial is at least partially within a channel of the washer and such that elongate portions of the radial are adjacent the corresponding open ends of the channel. The method may also include positioning the bushing relative to the radial and the washer such that the bushing and the washer cooperate to sandwich the radial's locking portion therebetween to thereby help retain the positioning of the radial's locking portion within the channel.

Further aspects and features of the present disclosure will become apparent from the detailed description provided hereinafter. In addition, any one or more aspects of the present disclosure may be implemented individually or in any combination with any one or more of the other aspects of the present disclosure. It should be understood that the detailed description and specific examples, while indicating exemplary embodiments of the present disclosure, are intended for purposes of illustration only and are not intended to limit the scope of the present disclosure.

DRAWINGS

The drawings described herein are for illustration purposes only and are not intended to limit the scope of the present disclosure in any way.

Figure 1:
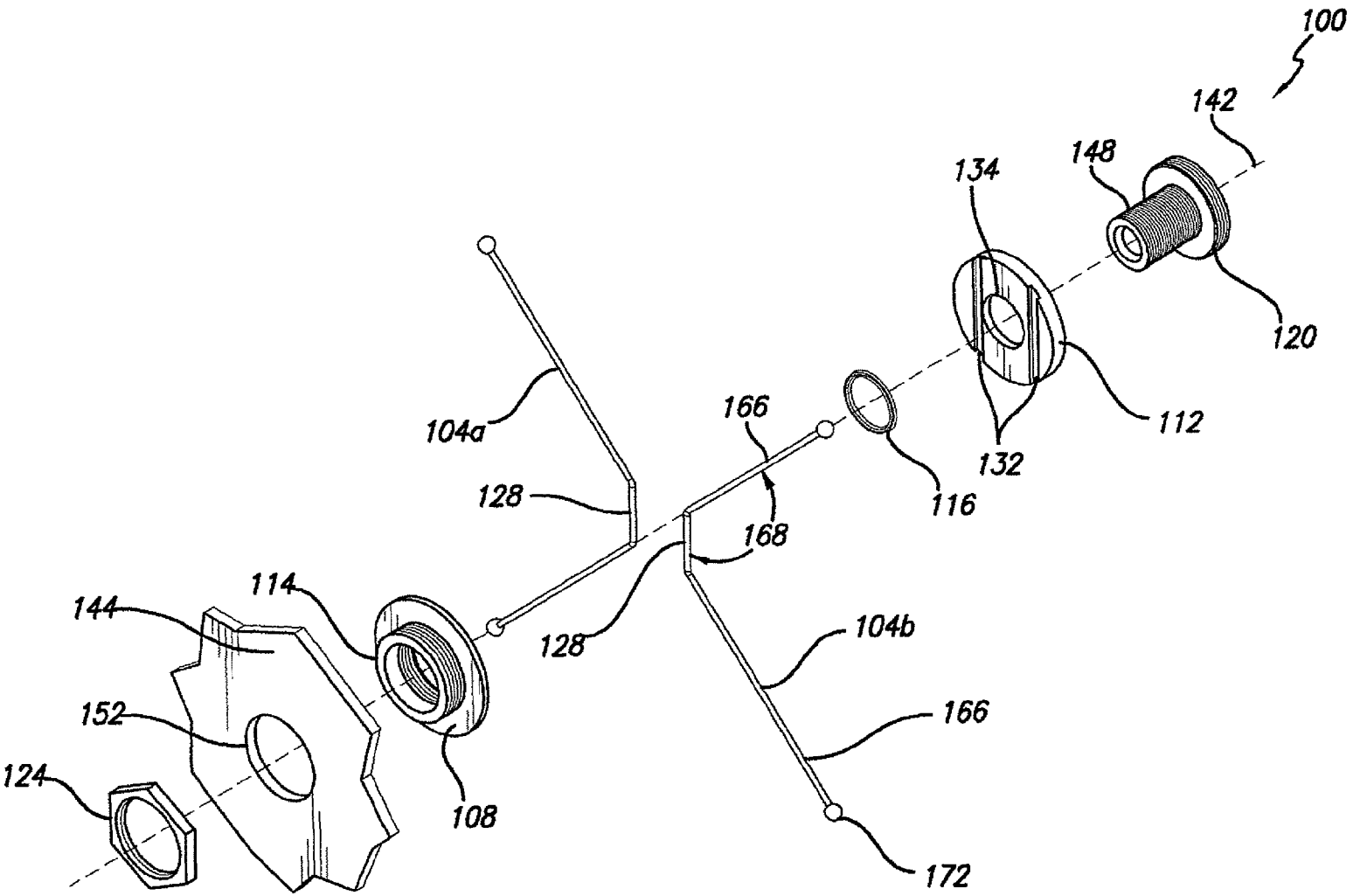
FIG. 1 is an exploded perspective view of an exemplary antenna radial system according to an exemplary embodiment.
Figure 11:
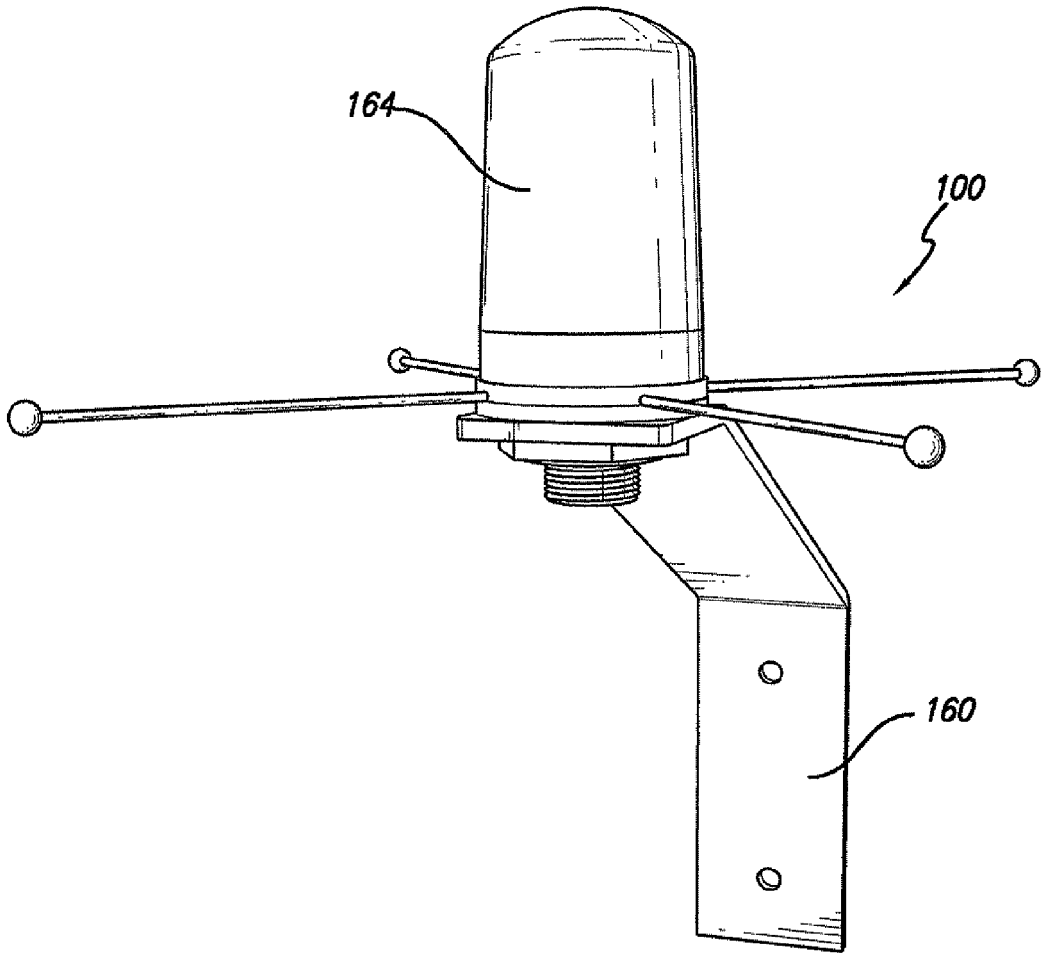
Figure 12:
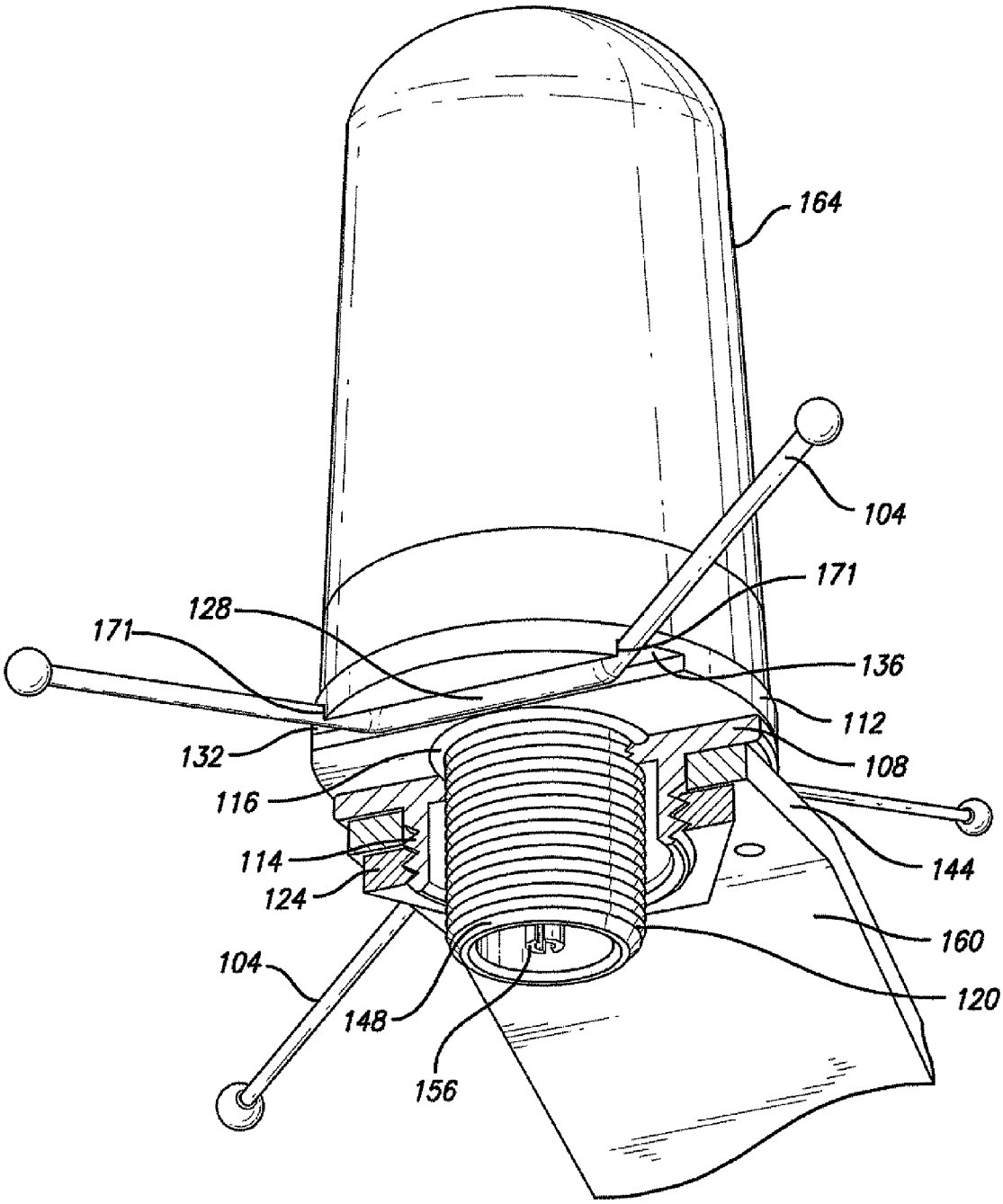

FIG. 11 is a perspective view illustrating an exemplary antenna assembly including the antenna radial system shown in FIG. 1, an antenna mount, and a cover according to an exemplary embodiment; and FIG. 12 is a lower partial perspective view of the assembly shown in FIG. 11 with a portion of the bushing, nut, and mounting surface removed to illustrate the adaptor and its inner electrical terminal pin receiving aperture according to an exemplary embodiment.

DETAILED DESCRIPTION

The following description is merely exemplary in nature and is in no way intended to limit the present disclosure, application, or uses. It should be understood that throughout the drawings, corresponding reference numerals indicate like or corresponding parts and features.

According to various aspects, exemplary embodiments are provided of antenna radial systems. In one exemplary embodiment, an antenna radial system generally includes a washer having a channel disposed along a first side of the washer. A radial includes a locking portion configured to be received within the channel. The radial also includes elongate portions extending outwardly from the locking portion such that an angle is defined between each elongate portion and the locking portion. A bushing cooperates with the washer for sandwiching the radial's locking portion therebetween to thereby help retain the radial's locking portion within the channel.

Additional aspects provide methods relating to antenna radial systems, such as methods of assembling, installing and/or using antenna radial systems. The antenna radial system may generally include a washer, a radial, and a bushing. In one exemplary embodiment, a method generally includes positioning a radial relative to the washer such that a locking portion of the radial is at least partially within a channel of the washer and such that elongate portions of the radial are adjacent the corresponding open ends of the channel. The method may also include positioning the bushing relative to the radial and the washer such that the bushing and the washer cooperate to sandwich the radial's locking portion therebetween to thereby help retain the positioning of the radial's locking portion within the channel.

As disclosed herein, an exemplary antenna radial system may generally include six primary components, namely, radial (e.g., wire radial, etc.), bushing, washer, sealing member (e.g., o-ring, etc.), antenna adaptor/connector (e.g., NMO (a new Motorola antenna mount) to N-Female adaptor, etc.), and a mechanical fastener or locking member (e.g., nut, etc.). The radial may be formed with two locking angles for locking inside a corresponding recessed channel, slot, or groove defined by the washer such the channel has two parallel inner sidewalls. The radial may be captured and retained within the channel by the bushing. The washer, sealing member, bushing, and radial may be assembled together along a centerline axis of a threaded portion (e.g., threaded stud, etc.) of the adaptor. With the radial locked in place within the channel (via the interaction between the washer and radial's locking angles and cooperation of the washer and the bushing to clamp, capture and retain the radial within the channel), the radial is thus constrained from movement in all three x, y, and z axes directions.

The antenna radial system disclosed herein may be secured to a mounting surface by inserting a threaded portion (e.g., threaded stud, etc.) of the bushing through a mounting hole in the mounting surface. Then, from the opposite side of the mounting surface, a nut (or other suitable mechanical fastener or locking member) may be threaded onto that threaded portion of the bushing that extends out through the mounting hole.

With reference now to the drawings, FIGS. 1 through 10 illustrate an exemplary embodiment of an antenna radial system 100 embodying one or more aspects of the present disclosure. As shown in FIG. 1, the illustrated antenna radial system 100 generally includes two radials 104 (e.g., wire radials, etc.), a bushing 108, a washer 112, a sealing member 116 (e.g., o-ring, etc.), an adaptor or connector 120 (e.g., NMO to N-female adaptor, etc.), and a nut 124 (or other suitable mechanical fastener or locking member).

Figure 6:
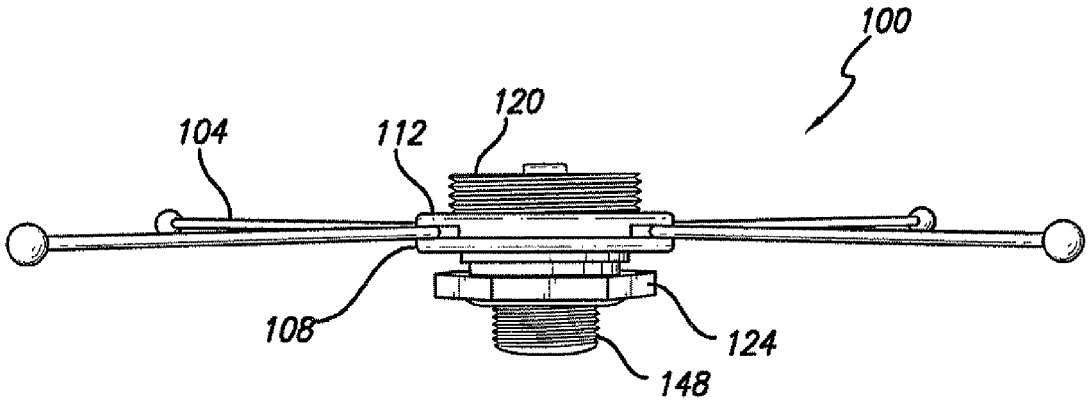
FIG. 6 is a side perspective view of the antenna radial system shown in FIG. 5.
Figure 7:
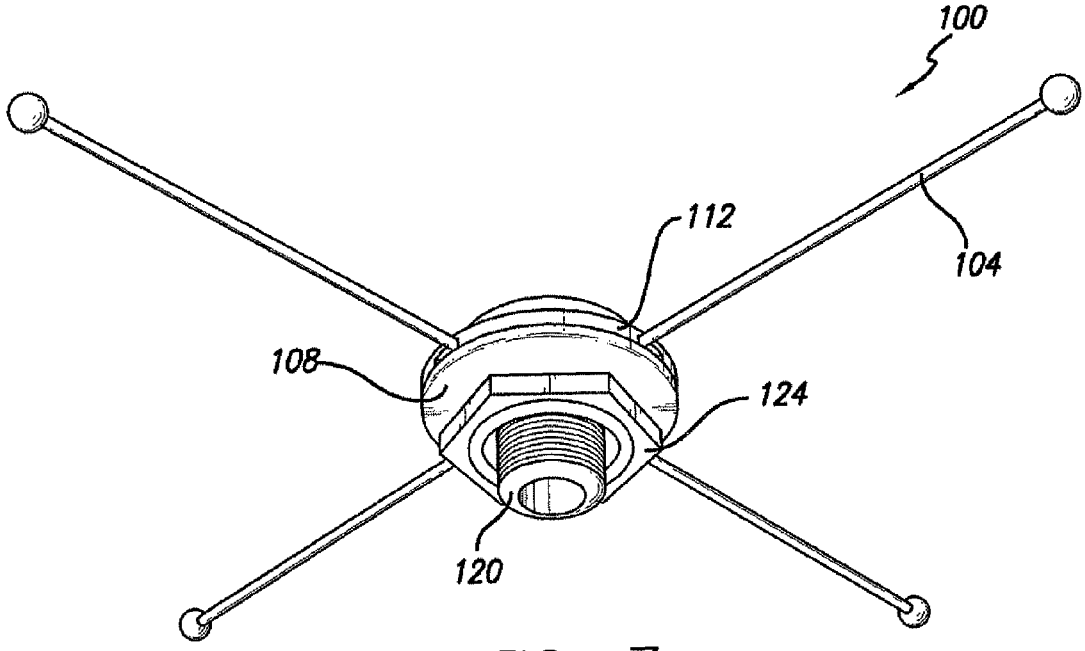
FIG. 7 is a lower perspective view of the antenna radial system shown in FIG. 5.
Figure 8:
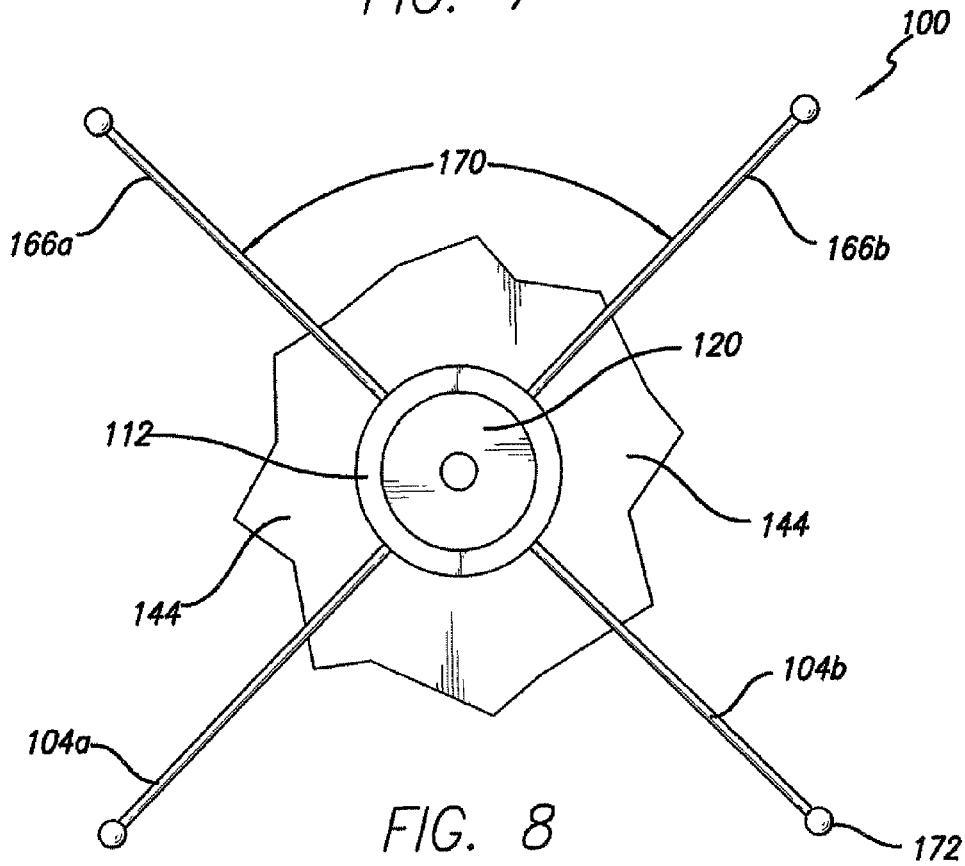
FIG. 8 is an upper plan view of the antenna radial system shown in FIG. 1 installed to the mounting surface.

The radials 104 include portions 128 that are configured to fit at least partially within channels, grooves, or slots 132 of the washer 112, as shown in FIG. 12. When the components of the antenna radial system 100 are assembled, the radial portions 128 are disposed within the channels 132 of the washer 112. As shown in FIG. 6, the washer 112 and bushing 108 essentially operate or function as clamp so as to capture and entrap the radial portion 128 therebetween. The radial portion 128 is thus sandwiched and retained generally between the bushing's upper surface 140 (FIG. 3) and the upper surface portion of the washer 112 that defines the top of the channel 132.

With reference to FIGS. 6 and 12, sliding movement (generally left and right movement in FIG. 12) of the radials 104 along or within the channels 132 may thus be inhibited by the interaction and physical contact (e.g., contact areas 171 designated in FIG. 12) of the radial's elongate portions 166*a*, 166*b* and the washer 112. In addition, the sidewall portions of the channels 132 may also inhibit movement (generally forwards and backwards in FIG. 12) of the radials 104 relative to the channels 132 in a direction generally perpendicular to the lengthwise direction of the channel 132. Movement (generally upwards and downwards in FIG. 12) of the radials 104 relative to the channels 132 may further be inhibited by cooperation between the washer 112 and the bushing 108 to sandwich and retain the radials 104 within the channels 132.

Figure 2:
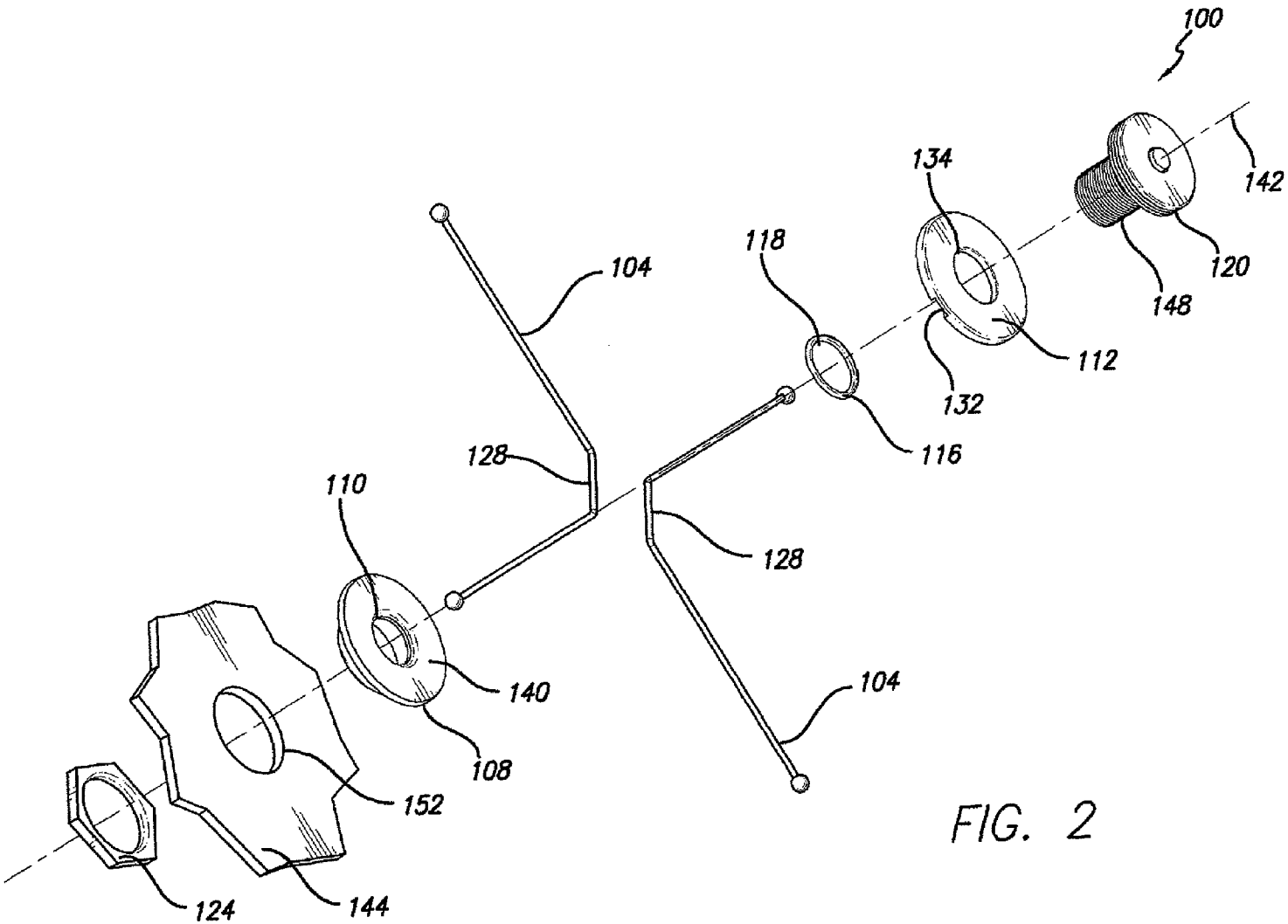
FIG. 2 is another exploded perspective view of the antenna radial system shown in FIG. 1.
Figure 3:
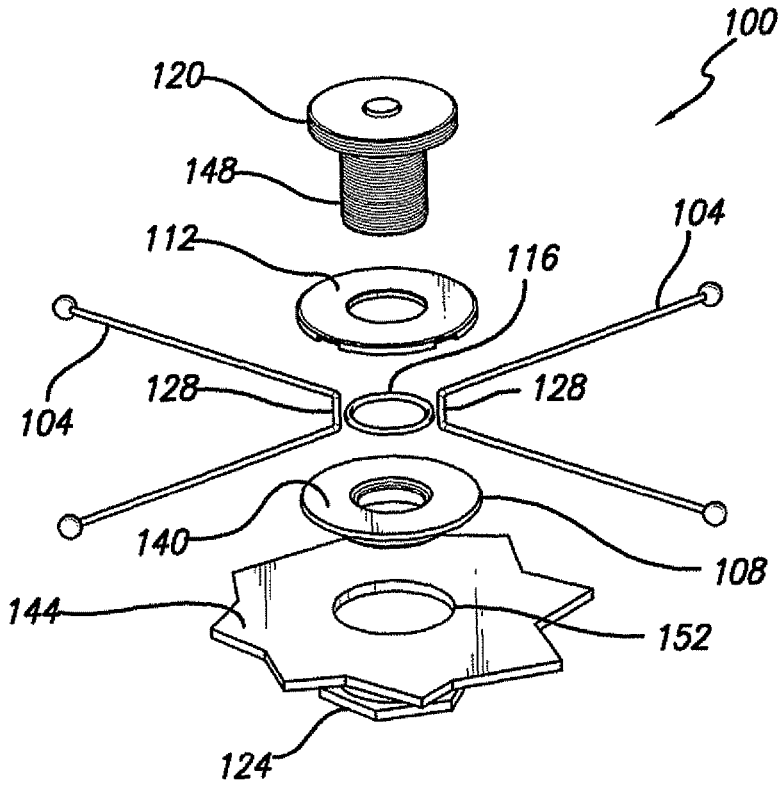
FIG. 3 is another exploded perspective view of the antenna radial system shown in FIG. 1 with the components axially aligned for installation to a mounting surface having a mounting hole according to an exemplary embodiment.
Figure 4:
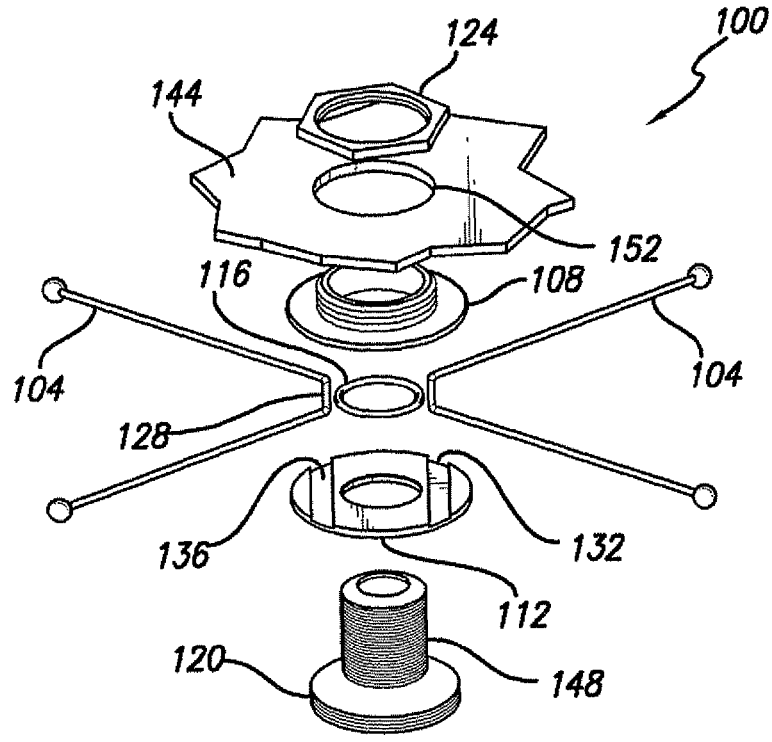
FIG. 4 is another exploded perspective view of the antenna radial system shown in FIG. 3.
Figure 5:
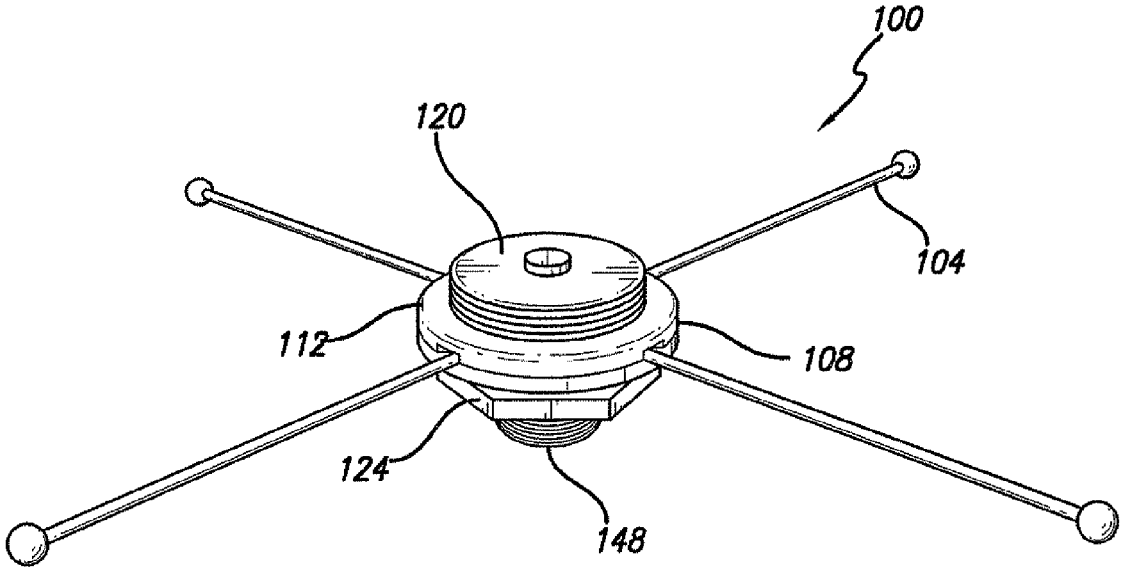
FIG. 5 is an upper perspective view of the antenna radial system shown in FIG. 1 after the components have been assembled.

An exemplary process for assembling and installing the antenna radial system 100 is now provided for purpose of illustration only. With reference to FIGS. 1 and 2, the components of the antenna radial system 100 may be aligned and axially mounted along an axis 142 as follows. The threaded protruding portion 148 (e.g., stud, etc.) of the adaptor 120 may be inserted through the respective openings 134 and 118 of the washer 112 and sealing member 116. The radial locking portions 128 may be positioned (e.g., nested, etc.) within the channels 132 of the washer 112.

With the radial locking portions 128 disposed within the grooves 132, the threaded protruding portion 148 of the adaptor 120 may be threadedly engaged with the internally threaded opening 110 of the bushing 108. At this stage of the process, the adaptor 120, washer 112, sealing member 116, radials 104, and bushing 108 are accordingly assembled so as to form a subassembly.

This subassembly may be moved relative to the mounting surface 144 so as to insert the threaded protruding portion 114 of the bushing 108 at least partially through the mounting hole 152. Then, from the opposite side of the mounting surface 140 (e.g., the lower surface in FIGS. 11 and 12, etc.), the nut 124 may be threaded onto the threaded portion 114 of the bushing 108 that is protruding outwardly through the mounting hole 152.

Alternative methods may also be used for assembling and/or installing the antenna radial system 100, including methods in which one or more of the above-described processes or operations are performed differently and/or in a different order. For example, some embodiments may include positioning the threaded protruding portion 148 of the bushing 108 through the mounting hole 152 and threadedly engaged the nut 124 thereto, before the adaptor 120, nesting washer 112, sealing member 116, and radials 104 are assembled to the bushing 108.

The components of the antenna radial system 100 will now be described in more detail, starting with the radials 104. As shown in FIG. 1, each radial 104 comprises a wire radial having a locking portion 128 and two elongate portions 166. Each elongate portion 166 extends outwardly from an end of the locking portion 128 such that a locking angle 168 (e.g., one hundred thirty-five degrees, acute angle, obtuse angle, right angle, etc.) is defined between each locking portion 128 and each elongate portion 166. In some embodiments, the radials 104 are also configured such that an angle 170 (FIG. 8) defined between adjacent elongate portions 166*a*, 166*b* of the radials 104*a*, 104*b* is between about seventy degrees and ninety degrees.

Preferably, the locking angles 168 are configured such that sliding movement (generally left and right in FIG. 12) of the radials 104 along or within the channels 132 is inhibited by the interaction and physical contact (e.g., contact areas 171 designated in FIG. 12) of the radial's elongate portions 166*a*, 166*b* and the nesting washer 112. In some embodiments, the radial locking portions 128 may be configured (e.g., have a large enough diameter, etc.) to form an interference or friction fit with the channel's sidewall portions. This interference or friction fit may help further retain the radials 104 within the corresponding channels 132 and constrain movement (e.g., sliding side-to-side movement and downward movement in FIG. 12) of the radials 104 relative to the washer 112. In addition, the sidewall portions of the channels 132 may inhibit movement (generally forwards and backwards in FIG. 12) of the radials 104 relative to the channels 132 in a direction generally perpendicular to the lengthwise direction of the channel 132. Vertical movement (generally upwards and downwards in FIG. 12) of the radials 104 relative to the channels 132 may be inhibited via the cooperative clamping function of the washer 112 and bushing 108 by which the radials 104 are sandwiched therebetween and retained within the channels 132. In this exemplary manner, the radials 104 may thus be locked into place such that the movement of the radials 104 is constrained in all three x, y, and z axis directions (or referring to FIG. 12 generally left, right, up, down, front, back). In FIG. 1, the axis 142 is may also be referred to as a z-axis for the antenna radial system 100.

Figure 9:
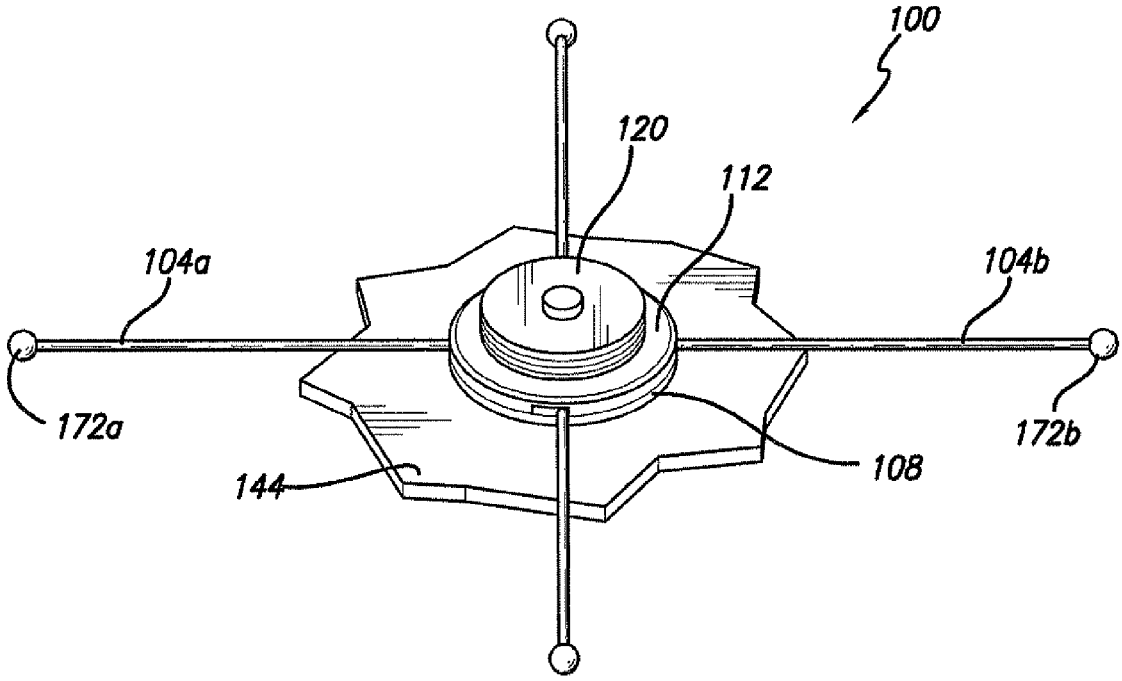
FIG. 9 is an upper perspective view of the antenna radial system shown in FIG. 8.
Figure 10:
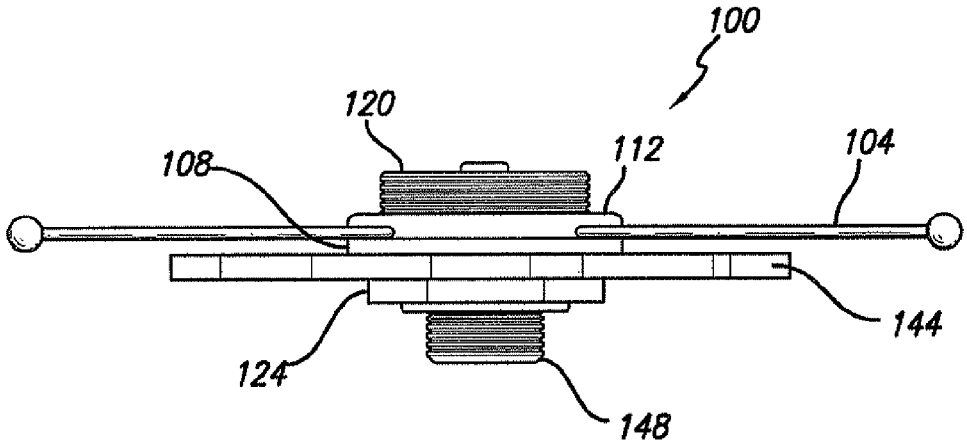
FIG. 10 is a side view of the antenna radial system shown in FIG. 8.

In addition, antenna balls 172 may be disposed (e.g., crimped, etc.) at the ends of the radial elongate portions 166. The radials 104 may be dimensionally sized such that the distance separating the antenna balls 172*a* and 172*b* shown in FIG. 9 is between about six inches and about twelve inches.

A wide range of materials may be used for the radials 104 and antenna balls 172, such as stainless steel, etc. In one exemplary embodiment, the radials 104 comprise stainless steel tempered ground wire radials. Alternative embodiments may include different numbers of radials and/or differently configured radials, such as radials having different shapes, different dimensions and/or angular values, differently shaped antenna balls, different materials, more or less than two elongate portions, etc., depending, for example, on the particular application.

With further reference to FIG. 1, the washer 112 includes two recessed slots, grooves, or channels 132. The channels 132 extend generally parallel with each other across the washer 112. Each channel 132 is defined by corresponding upper and sidewall surface portions 136 (FIG. 3) of the washer 112. Each channel 132 includes a generally inverted U-shaped or C-shaped cross-section or transverse profile. Alternative embodiments may have channels with different transverse profiles than what is shown in the figures depending, for example, at least in part on the configuration of the radials 104 to be received within the channels 132 of the washer 112.

Each channel 132 may be configured for frictionally engaging the corresponding radial locking portion 128 received within the channel 132. For example, the channel's sidewall portions may be configured to frictionally engage (e.g., grip, etc.) diametrically opposing sides of the radial locking portion 128.

By way of example only, the washer 112 may be formed from brass and be generally circular with an outer diameter of about 1.50 inches. Alternative embodiments may include differently configured washers (e.g., larger, smaller, different shapes, different materials, more or less than two slots, different slots, etc.).

With further reference to FIG. 1, the bushing 108 includes the upper surface 140 and the threaded protruding portion 114. By way of example only, the upper portion of the bushing 108 may be generally circular with an outer diameter of about 1.50 inches. The opening 110 (FIG. 2) of the bushing 108 may be configured (e.g., sized, threaded, etc.) for engageably receiving the threaded stud 148 of the adaptor 120. By way of example only, the bushing's opening 110 may be internally threaded for mating with a NMO to N-Female adaptor.

In some embodiments, the bushing 108 may be formed from a synthetic resin plastic (e.g., Delrin synthetic resin plastic, etc.) or other suitable electrically-insulating dielectric material (e.g., other plastics, etc.). In these embodiments, the bushing 108 may thus provide a direct current (DC) ground isolation option. By way of example, the bushing 108 may be further configured so as to provide the ground isolation option in compliance with Underwriter's Laboratory certification for certain applications. In other embodiments, the bushing 108 may be formed from brass (or other suitable material) so as to be electrically conductive for DC grounding purposes. Alternative embodiments may include differently configured bushings (e.g., larger, smaller, different shapes, different materials, etc.).

In the illustrated embodiment, the sealing member 116 is an O-ring, although other suitable sealing members may also be used. The sealing member 16 is configured such that when the antenna radial system 100 is assembled (FIG. 12), the sealing member 116 helps seal the washer's opening 134, bushing's threaded opening 110, and the interface between the washer 112 and the bushing 108. Accordingly, the sealing member 116 thus helps inhibit the ingress of moisture into the enclosed area under cover 164 (FIGS. 11 and 12) via the openings 134 and 110. Thus, some exemplary embodiments may include a water-proof construction and/or resistance to saltwater.

By way of example only, the sealing member 116 may be formed from rubber (e.g., ethylene propylene diene monomer (EPDM) rubber, etc.) and have a diameter of about 0.625 inches. Alternative embodiments may include more than one sealing member and/or differently configured (e.g., larger, smaller, different shapes, different materials, etc.) sealing members.

Referring to FIGS. 1, 2, and 12, the adaptor 120 is includes the threaded stud 148 and an inner electrical terminal pin receiving aperture 156 (FIG. 12). During the assembly and/or installation process for the antenna radial system 100, the adaptor's threaded stud 148 is threadedly engaged with the internal threading of the bushing's opening 110. In this illustrated embodiment, the adaptor 120 comprises a NMO mount-to-N-Female adaptor. Alternative embodiments may include other suitable connectors and adaptors, such as ISO (International Standards Organization) standard connectors, N-Female adaptors, coaxial cable connectors, Fakra connectors, brass connectors, Teflon connectors, etc.

In some embodiments, a coaxial cable (or other suitable communication link) may be electrically connected to the adaptor 120 for communicating signals between the antenna radial system 100 and another device, such as a radio receiver, display screen, and/or other suitable device. Accordingly, various embodiments allow for pluggable electrical connections between a communication link and the antenna radial system's adaptor or connector 120 without requiring the installer to route wiring or cabling through the mounting hole 152 of the mounting surface 144.

With continued reference to FIG. 12, the nut 124 includes internal threading for mating with the threaded protruding portion 114 of the bushing 108. By way of example only, the nut 124 may comprise a 0.125 inch hex nut formed from brass, nickel, etc. Alternative embodiments may include a wide range of other fastening means or locking devices for mounting the antenna radial system 100 to a mounting surface.

FIGS. 11 and 12 illustrate an exemplary mounting arrangement for the antenna radial system 100. As shown, the antenna radial system 100 may be mounted to the mounting surface 144, which, in turn, is supported and elevated by a mount 160 (e.g., pedestal, etc.). By way of example, the mounting surface 144 may be a generally flat planar surface defining a circular mounting hole 152 having a diameter of about one inch. The mount 160 and mounting surface 144 may comprise various materials (e.g., metal, plastic, fiberglass, etc.) depending, for example, on the particular application or end use for the antenna radial system. Alternative embodiments may include other antenna mounts, different mounting surfaces (e.g., different materials, sizes, shapes, locations, etc.), and/or differently configured mounting holes (e.g., different shapes, sizes, etc.).

Various antenna radial systems (e.g., 100, etc.) disclosed herein may be mounted to a wide range of supporting structures, including stationary platforms and mobile platforms. Accordingly, the specific mounting arrangement shown in FIGS. 11 and 12 should not be construed as limiting the scope of the present disclosure to any specific type of antenna mount, supporting structure, or environment.

Numerical dimensions and values and the specific materials disclosed herein are provided for illustrative purposes only. The particular dimensions, values, and materials disclosed are not intended to limit the scope of the present disclosure.

Certain terminology is used herein for purposes of reference only, and thus is not intended to be limiting. For example, terms such as "upper", "lower", "above", "below", "upward", "downward", "forward", and "rearward" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

The description of the disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. An antenna radial system comprising:

a washer having a channel disposed along a first side of the washer, the channel including an upper wall portion and sidewall portions;

a radial having a locking portion configured to be received within the channel, and elongate portions extending outwardly from the locking portion such that an angle is defined between each elongate portion and the locking portion;

a bushing configured to cooperate with the washer for sandwiching the radial's locking portion therebetween to thereby help retain the positioning of the radial's locking portion within the channel.

2. The antenna radial system of claim 1, wherein movement of the radial locking portion is constrained in each of three different axis directions relative to the antenna radial system.

3. The antenna radial system of claim 1, wherein sliding movement of the radial's locking portion within the channel is inhibited by contact between the washer and the radial.

4. The antenna radial system of claim 3, wherein:

sliding movement of the radial's locking portion within the channel in a first direction is inhibited by contact between the washer and one of the radial's elongate portions; and sliding movement of the radial's locking portion within the channel in a second direction opposite that of the first direction is inhibited by contact between the washer and the other one of the radial's elongate portion.

5. The antenna radial system of claim 1, wherein an interference fit is formed generally between the radial's locking portion and the channel sidewall portions, the interference fit inhibiting movement of the radial's locking portion within the channel.

6. The antenna radial system of claim 1, wherein the channel's sidewall portions inhibit movement of the radial's locking portion in a direction generally perpendicular to the channel sidewall portions.

7. The antenna radial system of claim 1, wherein an upper surface of the bushing inhibits generally downward movement of the radial locking portion, and wherein the channel's upper wall portion inhibits generally upward movement of the radial locking portion.

8. The antenna radial system of claim 1, wherein:

sliding movement of the radial's locking portion within the channel in a first direction is inhibited by contact between the washer and one of the radial's elongate portions;

sliding movement of the radial's locking portion within the channel in a second direction opposite that of the first direction is inhibited by contact between the washer and the other one of the radial's elongate portion.

the channel's sidewall portions inhibit movement of the radial's locking portion in respective third and fourth directions generally perpendicular to the corresponding channel sidewall portion;

an upper surface of the bushing inhibits movement of the radial's locking portion in a fifth generally downward direction; and the channel's upper wall portion inhibits movement of the radial's locking portion in a sixth generally upward direction.

9. The antenna radial system of claim 1, wherein the washer includes two channels, and wherein the antenna radial system includes two of said radials.

10. The antenna radial system of claim 1, wherein the channel has a generally inverted U-shaped profile.

11. The antenna radial system of claim 1, wherein the angle defined between each elongate portion and the locking portion of the radial is about one hundred thirty-five degrees.

12. The antenna radial system of claim 1, wherein the bushing is dielectric and provides direct current ground isolation for the antenna radial system.

13. The antenna radial system of claim 1, wherein the bushing is electrically conductive and provides electrically grounding for the antenna radial system.

14. The antenna radial system of claim 1, wherein the channel is integrally defined as a recessed channel extending inwardly into the first side of the washer.

15. The antenna radial system of claim 1, wherein the channel's sidewall portions are generally parallel to each other.

16. The antenna radial system of claim 1, further comprising a sealing member configured to be disposed generally between the washer and the bushing, for helping to fluidically seal the interface between the washer and the bushing.

17. The antenna radial system of claim 1, further comprising:

a nut having an internally threaded opening;

wherein:

the bushing includes a threaded portion threadedly engageable with the internally threaded opening of the nut; and the antenna radial system is mountable to a mounting surface when a first portion of the bushing is disposed on a first side of the mounting surface, the bushing's threaded portion is protruding at least partially through a mounting hole in the mounting surface, and the nut is threaded onto the bushing's threaded portion on a second side of the mounting surface.

18. The antenna radial system of claim 1, further comprising:

an adaptor having a threaded protruding portion;

wherein:

the bushing includes an internally threaded opening;

the threaded protruding portion of the adaptor is threadedly engageable with the internally threaded opening of the bushing, with the washer therebetween and with the radial locking portion disposed within the channel, thereby assembling the adaptor, washer, bushing, and radial.

19. The antenna radial system of claim 1, further comprising:

a nut having an internally threaded opening; and an adaptor having a threaded portion, wherein:

the bushing includes an internally threaded opening and a threaded portion threadedly engageable with the internally threaded opening of the nut; and the threaded portion of the adaptor is threadedly engageable with the internally threaded opening of the bushing, with the washer therebetween and with the radial locking portion disposed within the channel, thereby assembling the adaptor, washer, bushing, and radial;

the antenna radial system is mountable to a mounting surface when a first portion of the bushing is disposed on a first side of the mounting surface and when the bushing's threaded portion is protruding at least partially through a mounting hole in the mounting surface and threadedly engaged with the internally threaded opening of the nut on a second side of the mounting surface; and the adaptor is accessible from the second side of the mounting surface for a pluggable electrical connection to at least one communication link for communicating signals received by the antenna radial system.

20. The antenna radial system of claim 1, wherein the adaptor comprises an NMO to N-Female adaptor.

21. The antenna radial system of claim 1, further comprising an antenna ball disposed at a free end portion of each elongate portion.

22. The antenna radial system of claim 1, further comprising a connector configured such that, when the antenna radial system is mountable to a mounting surface with the radial on a first side of the mounting surface, the connector is accessible from a second side of the mounting surface for a pluggable electrical connection to at least one communication link for communicating signals received by the antenna radial system.

23. An antenna radial system mountable to a mounting surface having a mounting hole extending between first and second sides of the mounting surface, the antenna radial system comprising:

a washer having a channel disposed along a first side of the washer, the channel including an upper wall portion and sidewall portions;

a radial having a locking portion configured to be received within the channel, and elongate portions extending outwardly from the locking portion such that an angle is defined between each elongate portion and the locking portion;

a bushing having a threaded portion and an internally threaded opening;

a sealing member configured to be disposed generally between the washer and the bushing, for helping fluidically seal the interface between the washer and the bushing;

an antenna adaptor/connector having a threaded portion threadedly engageable to the bushing's internally threaded opening, with the washer and sealing member disposed generally therebetween and with the radial locking portion disposed within the channel, thereby assembling the adaptor, washer, sealing member, bushing, and radial; and a member with an internally threaded opening threadedly engageable with the bushing's threaded portion, wherein the antenna radial system is mountable to the mounting surface when a first portion of the bushing is disposed on the mounting surface's first side, and when the bushing's threaded portion is protruding at least partially through the mounting hole and threadedly engaged with the internally threaded opening of the member on the second side of the mounting surface; and wherein the antenna adaptor/connector is accessible from the second side of the mounting surface for a pluggable electrical connection to at least one communication link for communicating signals received by the antenna radial system.

24. The antenna radial system of claim 23, wherein movement of the radial locking portion is constrained in three different axis directions relative to the antenna radial system.

25. A method relating to an antenna radial system including a washer, a radial, and a bushing, the method comprising:

positioning a radial relative to the washer such that a locking portion of the radial is at least partially within a channel of the washer and such that elongate portions of the radial are adjacent the corresponding open ends of the channel, the radial's elongate portions extending outwardly from the locking portion such that an angle is defined between each elongate portion and the locking portion; and positioning the bushing relative to the radial and the washer such that the bushing and the washer cooperate to sandwich the radial's locking portion therebetween to thereby help retain the positioning of the radial's locking portion within the channel.

* * * * *